US008143769B2

(12) United States Patent
Li

(10) Patent No.: US 8,143,769 B2
(45) Date of Patent: Mar. 27, 2012

(54) LIGHT EMITTING DIODE (LED) LIGHTING DEVICE

(75) Inventor: Yi-Qun Li, Danville, CA (US)

(73) Assignee: Intematix Corporation, Fremont, CA (US)

( * ) Notice: Subject to any disclaimer, the term of this patent is extended or adjusted under 35 U.S.C. 154(b) by 232 days.

(21) Appl. No.: 12/206,347

(22) Filed: Sep. 8, 2008

(65) Prior Publication Data

US 2010/0060130 A1 Mar. 11, 2010

(51) Int. Cl.
*H01J 1/02* (2006.01)

(52) U.S. Cl. ..... 313/46; 362/294

(58) Field of Classification Search ..... 257/40, 257/72, 98–100, 642–643, 759; 313/498–512; 315/169.1, 169.3; 427/58, 64, 66, 532–535, 427/539; 428/690–691, 917; 438/26–29, 438/34, 82; 445/24–25
See application file for complete search history.

(56) References Cited

U.S. PATENT DOCUMENTS

| | | | | |
|---|---|---|---|---|
| 5,998,925 | A | 12/1999 | Shimizu | |
| 6,220,722 | B1 | 4/2001 | Begemann | |
| 6,793,374 | B2 * | 9/2004 | Begemann | 362/294 |
| 6,982,518 | B2 * | 1/2006 | Chou et al. | 313/46 |
| 7,144,135 | B2 | 12/2006 | Martin et al. | |
| 7,311,858 | B2 | 12/2007 | Wang | |
| 7,390,437 | B2 | 6/2008 | Dong | |
| 2002/0163006 | A1 * | 11/2002 | Yoganandan et al. | 257/81 |
| 2004/0149998 | A1 * | 8/2004 | Henson et al. | 257/98 |
| 2006/0145123 | A1 | 7/2006 | Li et al. | |
| 2006/0158090 | A1 | 7/2006 | Wang et al. | |
| 2006/0261309 | A1 | 11/2006 | Li et al. | |
| 2007/0029526 | A1 | 2/2007 | Cheng et al. | |
| 2007/0108459 | A1 | 5/2007 | Lu | |
| 2007/0240346 | A1 | 10/2007 | Li et al. | |
| 2008/0111472 | A1 | 5/2008 | Liu et al. | |
| 2008/0183081 | A1 * | 7/2008 | Lys et al. | 600/477 |

FOREIGN PATENT DOCUMENTS

| | | | |
|---|---|---|---|
| CA | 2 478 001 | | 2/2006 |
| WO | WO 2006/104553 | | 10/2006 |
| WO | WO 2007115322 | A2 * | 10/2007 |
| WO | WO 2007/130358 | | 11/2007 |
| WO | WO 2007/130359 | | 11/2007 |

OTHER PUBLICATIONS

International Search Report and Written Opinion dated Oct. 30, 2009 for International Application No. PCT/US2009/055413, 7 pages.
U.S. Appl. No. 12/127,749, filed May 27, 2008, His-Yan Chou.

* cited by examiner

*Primary Examiner* — Nimeshkumar Patel
*Assistant Examiner* — Donald Raleigh
(74) *Attorney, Agent, or Firm* — Fliesler Meyer LLP

(57) ABSTRACT

An LED lighting device comprises: a thermally conducting body having an at least one opening that connects with a cavity within the body and a plurality of LEDs mounted in thermal communication with a face of the body and positioned around the opening. One or more passages pass through the body from the cavity to an outer surface of the body and are configured such that in operation air moves through the cavity by thermal convection thereby to provide cooling of the body. Each passage is configured in a direction that extends in a direction at an angle of about 45° to a line that is parallel with the axis of the body toward the outer surface of the body away from the face. The body can be configured such that its outer surface has a form factor resembling an incandescent light bulb or halogen reflector lamp.

21 Claims, 12 Drawing Sheets

LIGHT EMITTING DIODE (LED) LIGHTING DEVICE

BACKGROUND OF THE INVENTION

1. Field of the Invention

This invention relates to a light emitting diode (LED) based lighting device and in particular to cooling such a device. In particular, although not exclusively, the invention concerns an LED lighting device that can be used as a replacement for a conventional filament lamp such as for example an incandescent light bulb or a halogen reflector lamp. Moreover, the invention concerns an alternating current (AC) driven LED lighting device that can be operated from a high voltage (110/220V) power supply.

2. Description of the Related Art

White light generating LEDs, "white LEDs", are a relatively recent innovation and offer the potential for a whole new generation of energy efficient lighting systems to come into existence. It is predicted that white LEDs could replace filament (incandescent), fluorescent and compact fluorescent light sources due to their long operating lifetimes, potentially many 100,000 of hours, and their high efficiency in terms of low power consumption. It was not until LEDs emitting in the blue/ultraviolet part of the electromagnetic spectrum were developed that it became practical to develop white light sources based on LEDs. As taught, for example in U.S. Pat. No. 5,998,925, white LEDs include one or more phosphor materials, that is photo-luminescent materials, which absorb a portion of the radiation emitted by the LED and re-emit radiation of a different color (wavelength). Typically, the LED chip or die generates blue light and the phosphor(s) absorbs a percentage of the blue light and re-emits yellow light or a combination of green and red light, green and yellow light or yellow and red light. The portion of the blue light generated by the LED that is not absorbed by the phosphor is combined with the light emitted by the phosphor to provide light which appears to the human eye as being nearly white in color.

To date high brightness white LEDs have been used to replace conventional incandescent light bulbs, halogen reflector lamps and fluorescent lamps. Most lighting devices utilizing LEDs comprise arrangements in which a plurality of LEDs replaces the conventional light source component. For example it is known to replace the filament assembly of an incandescent light bulb with white LEDs or groups of red, green and blue emitting LEDs. WO 2006/104553 teaches such an LED light bulb in which a plurality of white LEDs are mounted on a front face, back face and top edge of a generally rectangular substrate (printed circuit board) such that their combined light emission is generally spherical and replicates the light output of a conventional incandescent light bulb. The substrate is enclosed in a light transmissive cover and mounted to a connector base (e.g. screw cap) for coupling the bulb to a power source. U.S. Pat. No. 6,220,722 and U.S. Pat. No. 6,793,374 disclose an LED lamp (bulb) in which groups of white LEDs are mounted on the planar faces of a polyhedral support having at least four faces (e.g. cubic or tetrahedral). The polyhedral support is connected to a connector base by a heat dissipating column. The whole assembly is enclosed within a transparent bulb (envelope) such that it resembles a conventional incandescent light bulb.

A problem that needs addressing in the development of practical LED lighting devices, in particular compact devices that can be used as direct replacements for incandescent light bulbs, is adequately dissipating the heat generated by the large number of LEDs required in such devices and thereby preventing overheating of the LEDs. Various solutions have been proposed. One solution is to mount the LEDs on a heat sink which comprises the body of the device in which the heat sink is mounted to a conventional connector cap enabling the device to be used in a conventional lighting socket. As for example is described in U.S. Pat. No. 6,982,518 the heat sink can include a plurality of latitudinal fins to increase the surface area of the heat sink. A transparent or translucent domed cover can be provided over the LEDs such that the device bears a resemblance to a conventional light bulb. In U.S. Pat. No. 6,982,518 the form factor of the heat sink is shaped to substantially mimic the outer surface profile of an incandescent light bulb.

In U.S. Pat. No. 6,793,374, to aid in the dissipation of heat, the heat dissipating column can: include a heat sink; include inlet and outlet apertures for aiding air flow within the envelope; be in thermal communication with the cap; or include a fan to generate a flow of air in the lamp.

CA 2 478 001 discloses an LED light bulb in which the LEDs are mounted on a thermally conducting cylindrical core assembly. The core assembly is a segmented structure and comprises a stack of three different disks mounted on a rod. The LEDs are connected to circuit disks that are interposed between insulator disks and metallic disks. The core assembly is enclosed within a diffusing cover that includes an opening in its base and an impeller for creating a uniform turbulent flow of air over the core and out of holes in a cap.

WO 2007/130359 proposes completely or partially filling the shell (envelope) of an LED bulb with a thermally conductive fluid such as water, a mineral oil or a gel. The thermally conductive fluid transfers heat generated by the LEDs to the shell where it is dissipated through radiation and convection as in an incandescent light bulb. Similarly, WO 2007/130358 proposes filling the envelope with a thermally conductive plastic material such as a gel or liquid plastics material.

U.S. Pat. No. 7,144,135 teaches an LED lamp comprising an exterior shell that has the same form factor as a conventional incandescent PAR (parabolic aluminized reflector) type lamp. The lamp includes an optical reflector that is disposed within the shell and that directs the light emitted by one or more LEDs. The optical reflector and shell define a space that is used to channel air to cool the lamp and the LEDs are mounted on a heat sink that is disposed within the space between the shell and the reflector. The shell includes one or more apertures that serve as air inlet and exhaust apertures and a fan is provided within the space to move air over the heat sink and out of the exhaust apertures. Whilst such an arrangement may improve cooling the inclusion of a fan can make it too noisy or expensive for many applications and also less energy efficient due to the electrical power requirement of the fan.

As is known LEDs are intrinsically direct current (DC) devices that will only pass an electrical current in a single direction. In many lighting applications it is desirable to be able to operate LED lighting devices from a high voltage (110/250V) AC mains power supply requiring the use of rectifying circuitry. It is known to house the driver circuitry within the connector cap. It is also known to directly operate LEDs from an AC supply and to eliminate the need for driver circuitry by connecting the LEDs in a self-rectifying configuration. Typically, two strings of series-connected LEDs are connected in parallel with the LEDs in opposite polarity in a half-wave rectifier configuration such that the LEDs are self-rectifying. A sufficient number of LEDs is provided in each string to drop the total source voltage across the LEDs. During the positive half of the AC cycle one string of LEDs is forward biased and energized, while the other string is reverse biased. During the negative half of the AC cycle, the other string of LEDs is forward biased and energized, while the first string is reverse biased and not energized. Thus the strings are alternately energized at the frequency of the AC supply (50-60 Hz) and the device appears to be constantly energized. Although a self-rectifying configuration eliminates the need for separate driver circuitry it has the disadvantage that since only one LED string is energized at a time it has only a 50% payload and is power inefficient. Moreover, concerns have been expressed as to the effect on long term reliability of the LEDs of operating them in a constantly switched mode.

The present embodiments arose in an endeavor to provide an LED lighting device which at least in part overcomes the limitations of the known arrangements and in particular, although not exclusively, addresses the thermal management issues.

SUMMARY OF THE INVENTION

Embodiments of the invention are directed to an LED lighting device comprising a plurality of LEDs mounted on one or more faces of a thermally conducting body. The/each face has at least one opening that is in communication with at least one cavity within the body and the LEDs are mounted around the opening and in thermal communication with a respective face of the body. At least one passage that passes through the body from the at least one cavity to an outer surface of the body is configured such as to promote movement of air through the cavity by thermal convection through the at least one passage thereby to provide cooling of the body and the LEDs. The cavity and passage(s) together operate in a similar manner to a chimney (flue) in which, by the "chimney effect", air is in drawn in for combustion by the rising of hot gases in the flue. Consequently the cavity and passage(s) can collectively be considered to comprise a flue.

According to the invention a light emitting diode lighting device comprises: a thermally conducting body having at least one opening that connects with at least one cavity within the body; a plurality of LEDs mounted in thermal communication with a face of the body and positioned around the opening; and at least one passage passing through the body from the cavity to an outer surface of the body and configured such that in operation air moves through the at least one cavity by thermal convection thereby to provide cooling of the body. The one or more cavities and passages can (i) increase the heat emitting surface area of the body by up to about 30%; (ii) reduce a variation in the heat sink performance of each LED and (iii) increase heat dissipation by 15 to 25%. Arranging the LEDs around the opening(s) to the one or more cavities reduces the length of the thermal conduction path each device to a heat emitting surface of the body and promotes a more uniform cooling of the LEDs. In contrast, in an arrangement that does not include a central cavity and in which the LEDs are arranged as an array, heat generated by LEDs at the center of the array will have a longer thermal conduction path to a heat emitting surface than that of heat generated by devices at the edges of the array, resulting in a lower heat sink performance for LEDs at the center of the array. Although the cavity increases the heat emitting surface area of the body, the cavity could trap heated air when the device is operated with the face/opening oriented in a downward direction were it not for the at least one passage that enables such air to escape and in doing so thereby establishes a flow of air through the cavity/passage to provide further cooling of the device.

To promote the flow of air the at least one passage is configured to extend in a direction from an axis of the body to the outer surface of the body away from the face. The passage (s) can extend in a direction at an angle in a range 0° to about 90° to a line parallel with the axis of the body. Since the orientation at which the device will be operated is unknown and will differ from one user to another, the passage(s) will typically extend at an angle in a range 30° to 60°, preferably about 45°, such as to promote a flow of air will occur regardless of the orientation of the device.

In one embodiment the body is substantially a frustrum of a cone (frustconical) and the base comprises the face on which the LEDs are mounted. Preferably, the at least one cavity is also substantially frustoconical or substantially conical in form and is substantially coaxial with the body. To enable the device to be used directly in existing lighting fixtures, the body can be configured such that its outer surface has a form factor that resembles the envelope (bulb) of an incandescent light bulb, an MR-16 halogen reflector lamp or an MR-11 halogen reflector lamp. The body can take other forms and in one arrangement it can be substantially cylindrical in form.

To increase the flow of air the device advantageously comprises a plurality of passages connecting the cavity to the outer surface of the body. The plurality of passages can be circumferentially spaced and/or axially spaced. The passages can extend in directions at different angles to a line that is parallel with the axis of the body to maximize the flow of air irrespective of the orientation of operation of the device.

To further assist in the dissipation of heat the body advantageously further comprises a plurality of heat radiating fins (veins) or other heat radiating features extending from a surface of the body. The plurality of heat radiating fins can extend from the outer surface of the body and/or from a surface of the at least one cavity or the one or more passages. The body can be fabricated from any material with a high thermal conductivity (typically $\geqq 150\ Wm^{-1}K^{-1}$ and preferably $\geqq 200\ Wm^{-1}K^{-1}$) such as for example copper, aluminum, anodized aluminum, an aluminum alloy, a magnesium alloy or a metal loaded plastics material or a thermally conductive ceramic such as aluminum silicon carbide (AlSiC). Preferably the body has a dark finish, preferably black, to further increase the radiation of heat from the body.

The LEDs are advantageously spaced around the opening with a separation such that an intensity of light emitted by the device is generally uniform. In the context of this patent, "generally uniform" means a variation in intensity of less than about 25% and preferably less than about 10%. Typically, the light emitting diodes are separated with a spacing in a range to 1 to 5 mm. To increase the intensity of light emission of the device the LEDs can be grouped in arrays and the arrays of LEDs located around the opening. Typically the LED arrays can be separated with a spacing in a range 1 to 5 mm.

Spacing the LEDs around the opening such that the device produces a generally uniform emission of light is considered inventive in its own right. Thus according to a further aspect of the invention a light emitting diode lighting device comprises: a body having an opening that passes through a face of the body and a plurality of light emitting diodes mounted on the face and positioned around the opening; wherein the light emitting diodes are spaced around the opening with a separation such that an intensity of light emitted by the device is substantially uniform.

To further increase the uniformity of intensity of light emission devices in accordance with the various aspects of the invention can further comprise a lens arrangement overlying the light emitting diodes.

The devices of the invention find particular application in general lighting where the illumination product will most often be white light. In such applications the light emitting diodes can be white light emitting LEDs that incorporate a phosphor material, so called "white LEDs". Alternatively, in other arrangements at least one phosphor material can be provided overlying the plurality of light emitting diodes, said phosphor material being operable to absorb at least a part of the light emitted by an associated light emitting diode and to re-emit light of a different wavelength. The phosphor, which is typically in the form of a powder, can be mixed with a light transmissive binder material such as a polymer material (for example a thermally or UV curable silicone or an epoxy material) and the polymer/phosphor then extruded into a sheet. The phosphor sheet can be cut or stamped into appropriately shaped pieces that are then mounted overlying the LEDs. One advantage of separately fabricating a sheet of phosphor-containing material is that it is possible to generate a more consistent color and/or correlated color temperature (CCT) of emitted light since the generation of light by photoluminescence of the phosphor occurs over a larger area compared to the area when the phosphor is incorporated as a part of the LED package. A further advantage is a reduction in manufacturing costs since a single LED, typically a blue (400 to 480 nm) light emitting LED, is required and the CCT and/or color hue of light generated by the device selected by application of an appropriate sheet of phosphor-containing material. Another advantage is that since the phosphor is not in direct thermal communication with the LED chip this can reduce thermal degradation of the phosphor.

As described the devices of the invention are intended for general lighting and the device can be configured as a replacement for an incandescent light bulb or halogen reflector lamp. In such applications the device preferably further comprises an electrical connector such an Edison screw base (E26 or E27); a bayonet connector base (BC); a double contact bayonet connector base (B22d), a bipin (2-pin) base (GU5.3 or GX5.3) or a GU10 "turn and lock" for connecting the device to a power source using a conventional lighting socket. The LEDs can be connected in a self-rectifying configuration such that the device can be directly driven from an AC power source. Alternatively, the LEDs can be connected between the rectifying nodes of a bridge rectifier comprising separate diodes. Conveniently, the bridge rectifier can be housed within the connector.

According to a yet further aspect of the invention an LED lighting device comprises: a thermally conducting body having at least one flue connecting an opening in the body with an outer surface of the body and a plurality of light emitting diodes mounted in thermal communication with a face of the body and positioned around the flue opening; wherein the at least one flue is configured such that in operation air moves through the at least one flue by thermal convection thereby to provide cooling of the body.

BRIEF DESCRIPTION OF THE DRAWINGS

In order that the present invention is better understood light emitting devices according to the invention will now be described, by way of example only, with reference to the accompanying drawings in which.

DETAILED DESCRIPTION OF THE INVENTION

A white light emitting LED lighting device 10 in accordance with a first embodiment of the invention will now be described with reference to FIGS. 1 to 3 of the accompanying drawings. The LED lighting device 10 is configured for operation with a 110V (r.m.s.) AC (60 Hz) mains power supply as is found in North America and is intended for use as a direct replacement for an incandescent light bulb/reflector lamp.

Figure 1:
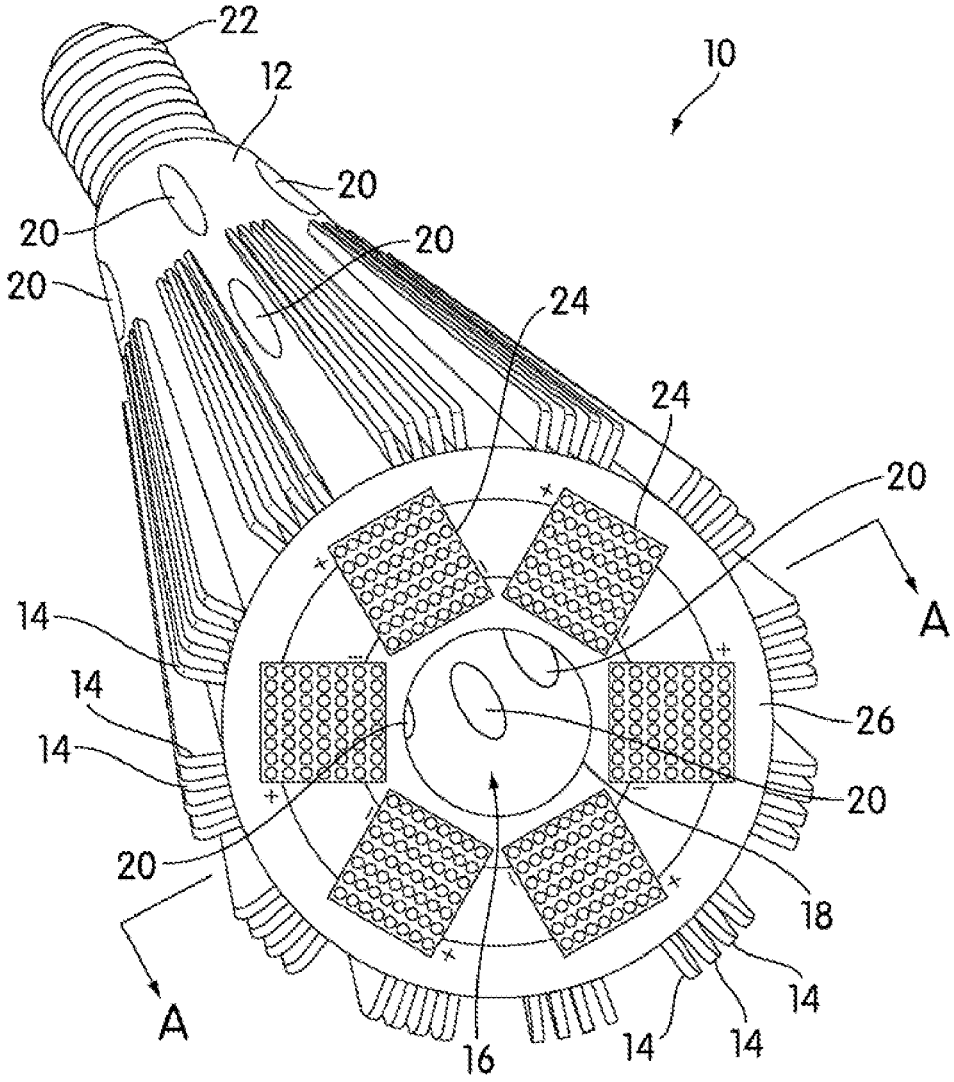
FIG. 1 is a schematic perspective representation of an LED lighting device in accordance with the invention.
Figure 2:
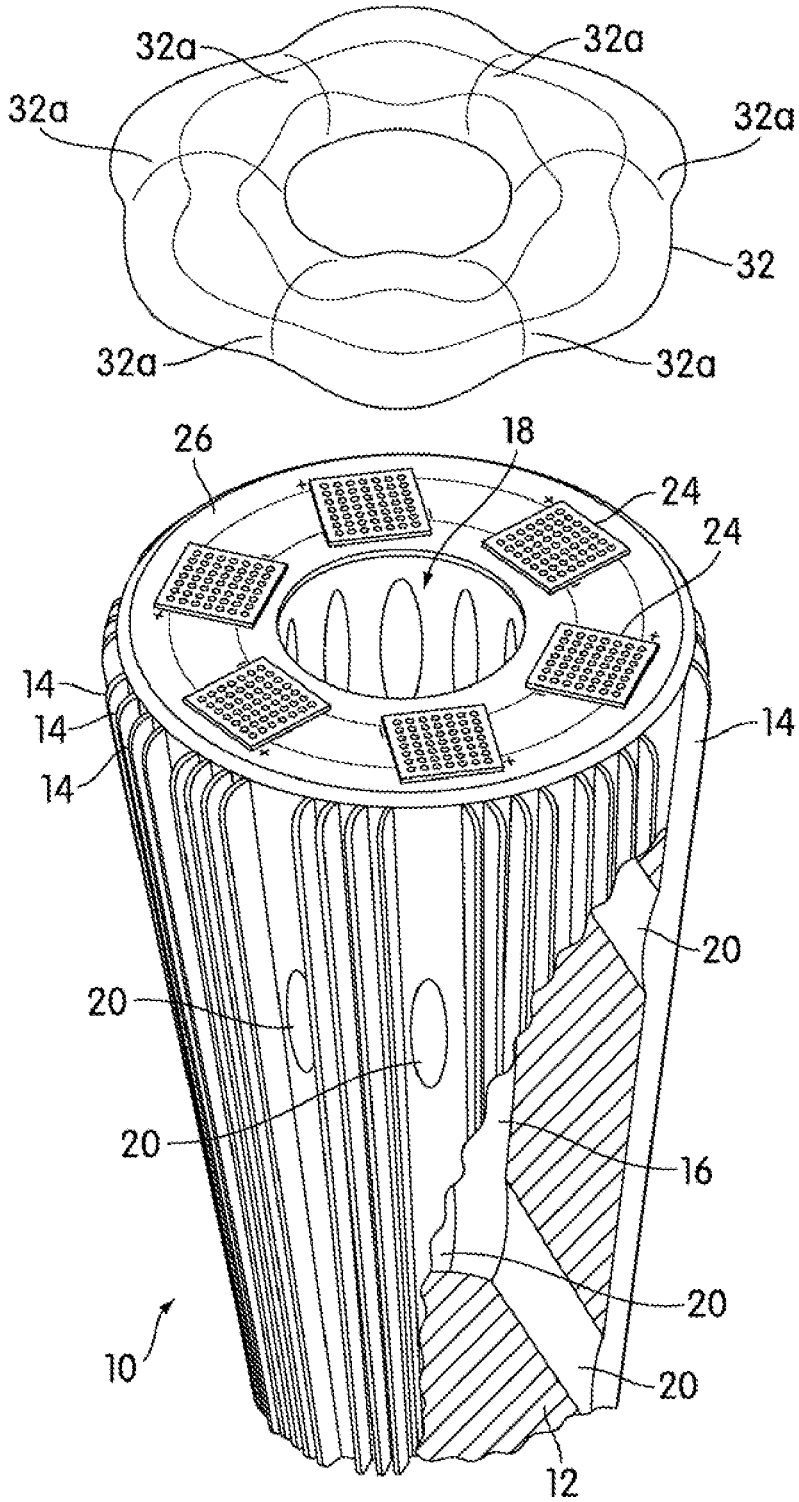
FIG. 2 is a part sectional, partially exploded, schematic perspective representation of the LED lighting device of FIG. 1.
Figure 3:
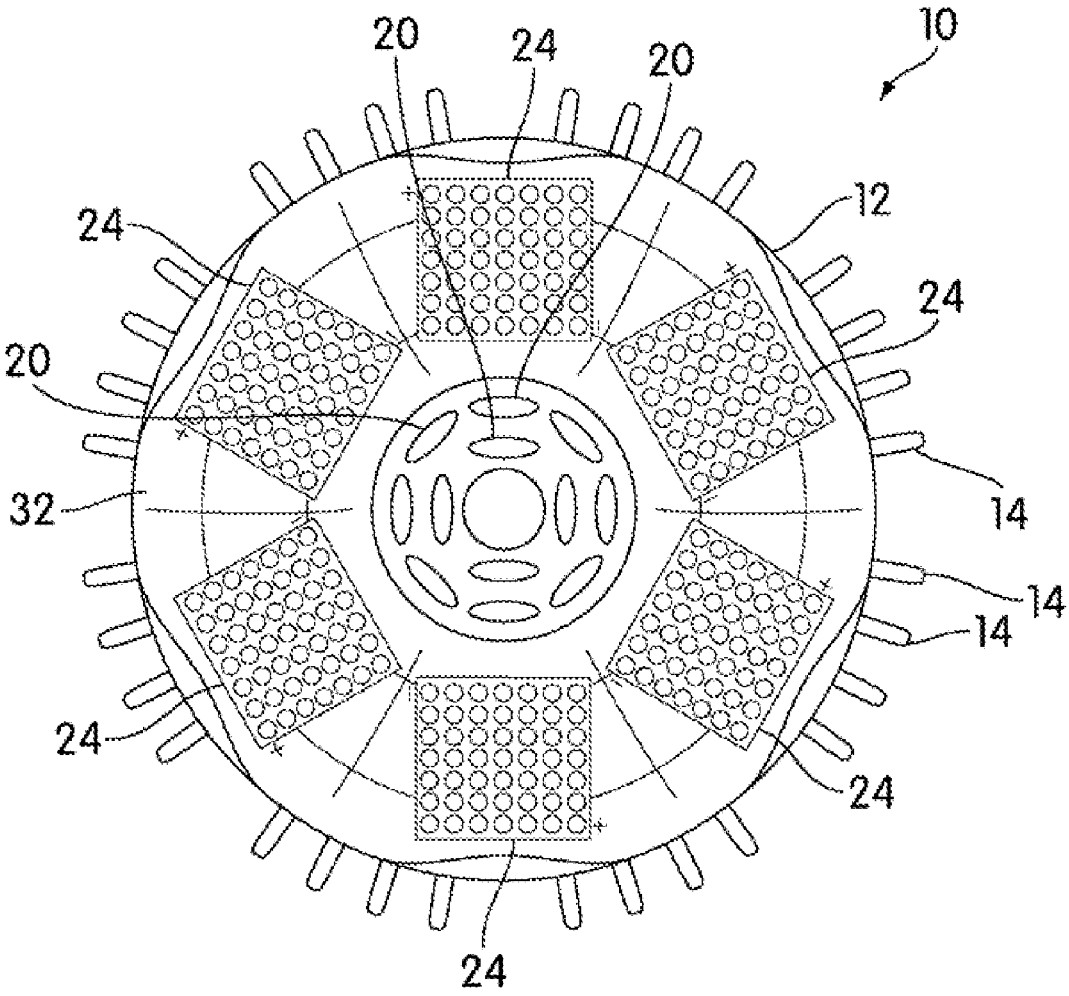
FIG. 3 is a plan view of the LED lighting device of FIG. 1 in direction toward the light emitting face of the device.

Referring to FIGS. 1 to 3 the LED lighting device 10 comprises a generally conical shaped thermally conducting body 12. The body 12 is a solid body whose outer surface generally resembles a frustrum of a cone; that is, a cone whose apex or vertex is truncated by a plane that is parallel to the base (substantially frustoconical). The body 12 is made of a material with a high thermal conductivity (typically $\geqq 150$ $Wm^{-1}K^{-1}$, preferably $\geqq 200$ $Wm^{-1}K^{-1}$) such as for example copper ($\approx 400$ $Wm^{-1}K^{-1}$), aluminum ($\approx 250$ $Wm^{-1}K^{-1}$), anodized aluminum, an alloy of aluminum, a magnesium alloy, a metal loaded plastics material such as a polymer, for example an epoxy or a thermally conducting ceramic material such as for example aluminum silicon carbide (AlSiC) ($\approx 170$ to 200 $Wm^{-1}K^{-1}$). Conveniently the body 12 can be die cast when it comprises a metal alloy or molded when it comprises a metal loaded polymer or thermally conductive ceramic.

A plurality of latitudinal heat radiating fins (veins) 14 are circumferentially spaced around the outer curved surface of the body. Since the lighting device is intended to replace a conventional incandescent light bulb the dimensions of the device are selected to ensure that the device will fit a conventional lighting fixture and as a result the length of the body in an axial direction is in a range 65 to 100 mm, typically 90 mm and the maximum diameter including the heat radiating fins (that is substantially the diameter of the base) in a range 60 to 80 mm, typically about 65 mm.

A coaxial substantially right circular conical cavity (bore) 16 extends into the body 12 from a circular opening 18 in the base of the body. Twelve generally circular tapering passages (conduits) 20 connect the cavity 16 to the outer curved surface of the body. In the exemplary embodiment the passages 20 are grouped in a first group of eight in which the openings of passages within the cavity are located in proximity to the base of the body and a second group of four in which the openings of the passages within the cavity are located towards the apex of the cavity. The passages are circumferentially spaced and each passage 20 extends in a generally radial direction in a direction away from the base of the body, that is, as shown in a generally upwardly extending direction. As illustrated the angle of inclination θ of the passages is about 25° and is measured relative a line that is parallel to the axis of the body and which passes through the center of the opening within the cavity. It will be appreciated that the number, size, geometry, grouping and angle of inclination of the passages are only exemplary and can be readily tailored by those skilled in the art for a given application. As will be further described the passages 20 enable a flow of air through the body to increase cooling of the device. To further aid in the dissipation of heat the passages 20 and/or cavity 16 can also include a series of heat radiating fins. However, for simplicity no fins are illustrated within the cavity 16 or passages 20 in the accompanying figures.

The device 10 further comprises an E26 connector cap (Edison screw lamp base) 22 enabling the device to be directly connected to a mains power supply using a standard electrical lighting screw socket. It will be appreciated that depending on the intended application other connector caps can be used such as, for example, a double contact bayonet connector (i.e. B22d or BC) as is commonly used in the United Kingdom, Ireland, Australia, New Zealand and various parts of the British Commonwealth or an E27 screw base (Edison screw lamp base) as used in Europe. The connector cap 22 is mounted to the truncated apex of the body 12 and the body electrically insulated from the cap 22.

Figure 4:
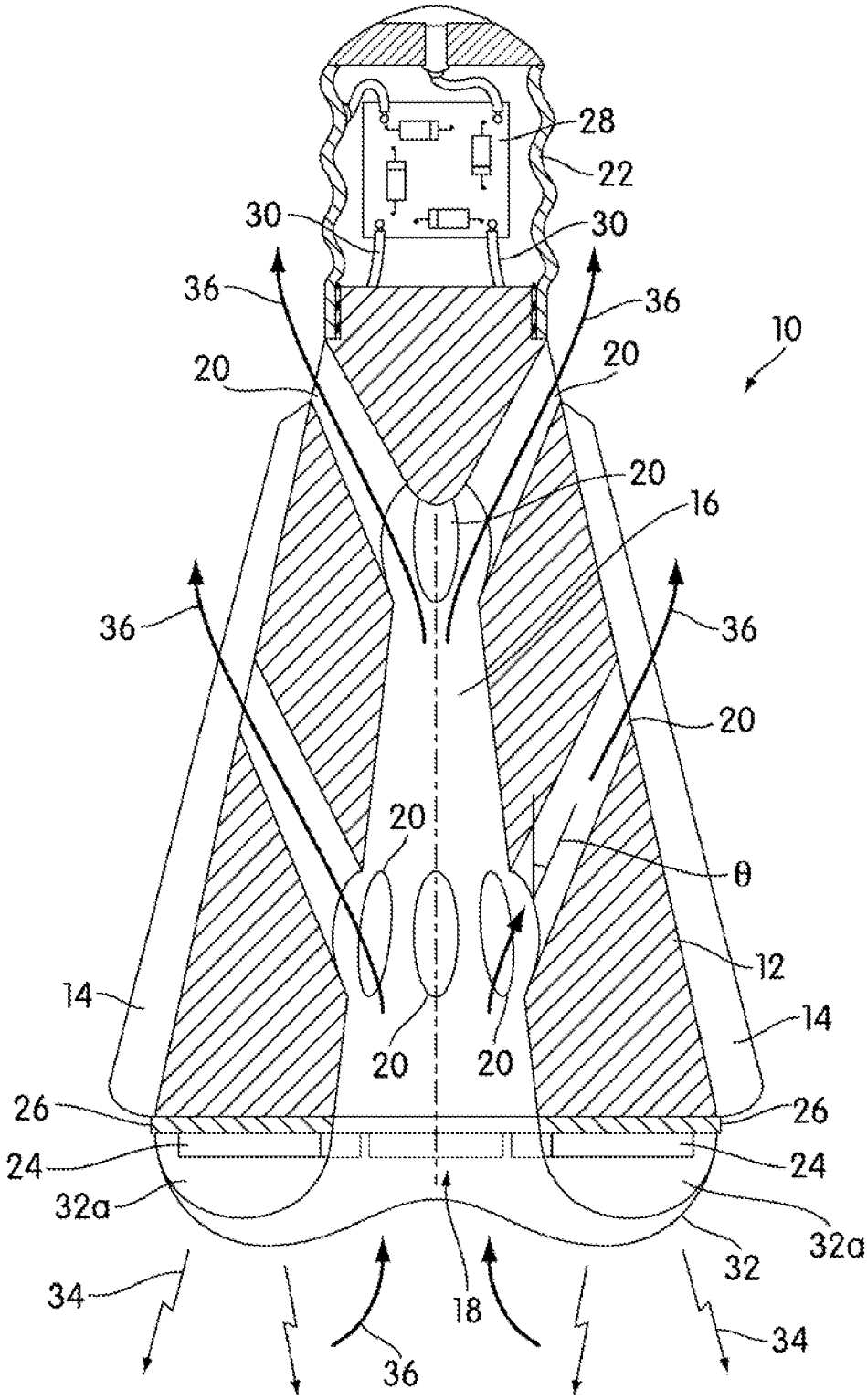
FIG. 4 is a schematic sectional representation of the LED lighting device of FIG. 1 through a plane A-A for a first orientation of operation.
Figure 5A:
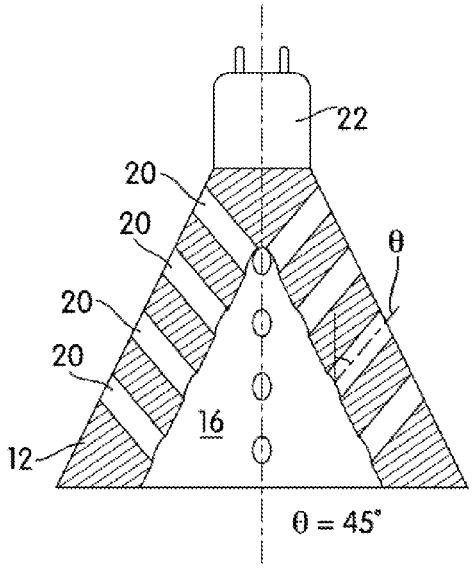
FIGS. 5(*a*) to 5(*d*) are schematic sectional representations of a thermally conducting body illustrating example passage configurations that extend at an angle θ of (a) 45°, (b) 90°, (c) 0° and (d) 10° and 30°.
Figure 5B:
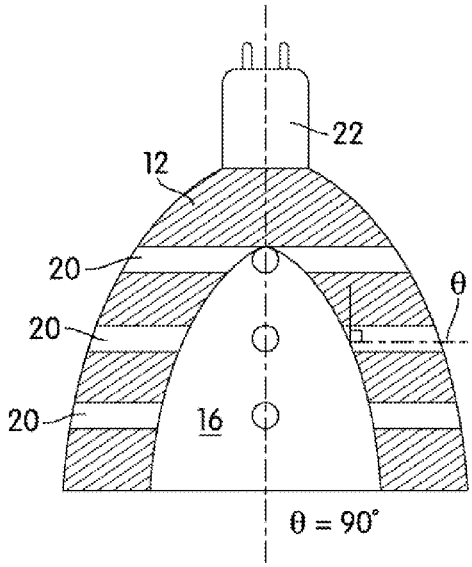
Figure 5C:
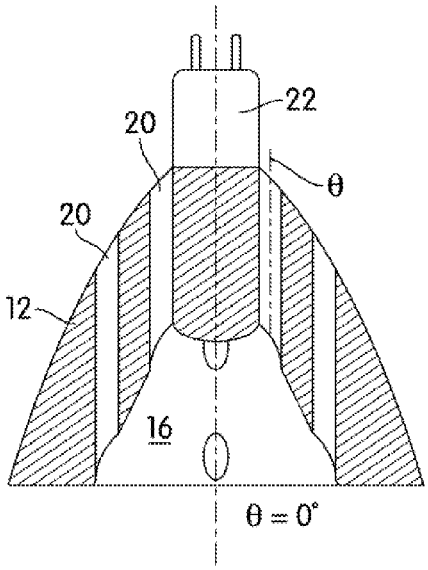
Figure 5D:
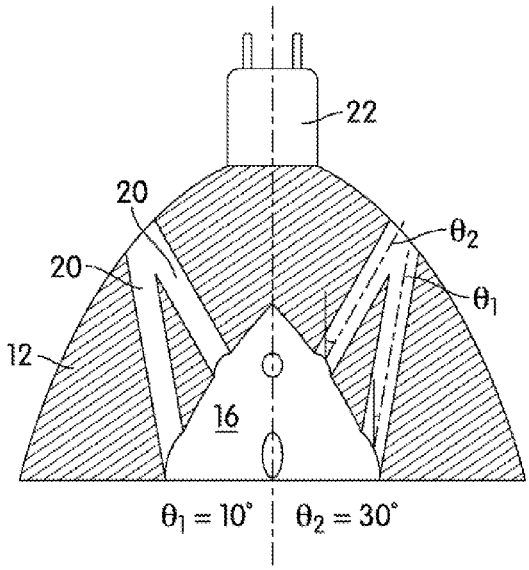

A plurality (six in the example illustrated) of LED devices 24 are mounted as an annular array on an annular shaped MCPCB (metal core printed circuit board) 26. As is known a MCPCB comprises a layered structure composed of a metal core base, typically aluminum, a thermally conducting/electrically insulating dielectric layer and a copper circuit layer for electrically connecting electrical components in a desired circuit configuration. The metal core base of the MCPCB 26 is mounted in thermal communication with the base of the body 12 with the aid of a thermally conducting compound such as for example an adhesive containing a standard heat sink compound containing beryllium oxide or aluminum nitride. The circuit board 26 is dimensioned to be substantially the same as the base of the body 12 and includes a hole corresponding to the circular opening 18. Rectifier circuitry 28 for operating the lighting device 10 directly from a mains power supply can, as shown in FIG. 4, be housed within the connector cap 22. Electrical power is supplied to the LED devices 24 by connecting wires 30 located within conduits (not shown) that pass through the body 12 between the base and the apex of the body.

Each LED device 24 preferably comprises a plurality of co-packaged LED chips as for example is described in co-pending U.S. application Ser. No. 12/127,749 filed May 27, 2008, the entire content of which is incorporated herein by way of reference thereto. In the embodiment described, each LED device 24 comprises a square multilayered ceramic package having a square array of forty nine (seven rows by seven columns) circular recesses (blind holes) that can each house a respective LED chip enabling up to forty nine LED chips to be packaged in a single ceramic package. Typically the ceramic package is 12 mm square and each recess 1 mm in diameter with a spacing of 2 mm between the centers of neighboring recesses. For 110V AC operation each LED device 24 will typically contain forty five series-connected 65 mW gallium nitride-based blue emitting LED chips 24 such that during operation each LED chip drops a peak voltage of 3.426V [(AC Peak Voltage−Voltage drop across rectifier diodes)÷number of LEDs: (110×1.414−2×0.68)/45=3.426]. The LED devices 24 are connected in parallel between the rectified nodes of a diode bridge rectifier. Since it is required to generate white light each recess can be potted with a phosphor (photo luminescent material) material.

The phosphor material, which is typically in powder form, is mixed with a transparent binder material such as a polymer material (for example a thermally or UV curable silicone or an epoxy material) and the polymer/phosphor mixture applied to the light emitting face of each LED chip.

The light emitting device of the invention is particularly suited for use with inorganic phosphors such as for example silicate-based phosphor of a general composition $A_3Si(O,D)_5$ or $A_2Si(O,D)_4$ in which Si is silicon, O is oxygen, A comprises strontium (Sr), barium (Ba), magnesium (Mg) or calcium (Ca) and D comprises chlorine (Cl), fluorine (F), nitrogen (N) or sulfur (S). Examples of silicate-based phosphors are disclosed in our co-pending patent applications US2006/0145123, US2006/0261309, US2007/0029526 and U.S. Pat. No. 7,311,858 (also assigned to Intematix Corporation) the content of each of which is hereby incorporated by way of reference thereto.

As taught in US2006/0145123, a europium ($Eu^{2+}$) activated silicate-based green phosphor has the general formula $(Sr,A_1)_x(Si,A_2)(O,A_3)_{2+x}:Eu^{2+}$ in which: $A_1$ is at least one of a $2^+$ cation, a combination of $1^+$ and $3^+$ cations such as for example Mg, Ca, Ba, zinc (Zn), sodium (Na), lithium (Li), bismuth (Bi), yttrium (Y) or cerium (Ce); $A_2$ is a $3^+$, $4^+$ or $5^+$ cation such as for example boron (B), aluminum (Al), gallium (Ga), carbon (C), germanium (Ge), N or phosphorus (P); and $A_3$ is a $1^-$, $2^-$ or $3^-$ anion such as for example F, Cl, bromine (Br), N or S. The formula is written to indicate that the $A_1$ cation replaces Sr; the $A_2$ cation replaces Si and the $A_3$ anion replaces oxygen. The value of x is an integer or non-integer between 1.5 and 2.5.

U.S. Pat. No. 7,311,858 discloses a silicate-based yellow-green phosphor having a formula $A_2SiO_4:Eu^{2+}D$, where A is at least one of a divalent metal comprising Sr, Ca, Ba, Mg, Zn or cadmium (Cd); and D is a dopant comprising F, Cl, Br, iodine (I), P, S and N. The dopant D can be present in the phosphor in an amount ranging from about 0.01 to 20 mole percent and at least some of the dopant substitutes for oxygen anions to become incorporated into the crystal lattice of the phosphor. The phosphor can comprise $(Sr_{1-x-y}Ba_xM_y)SiO_4:EU^{2+}D$ in which M comprises Ca, Mg, Zn or Cd and where $0 \leqq x \leqq 1$ and $0 \leqq y \leqq 1$.

US2006/0261309 teaches a two phase silicate-based phosphor having a first phase with a crystal structure substantially the same as that of $(M1)_2SiO_4$; and a second phase with a crystal structure substantially the same as that of $(M2)_3SiO_5$ in which M1 and M2 each comprise Sr, Ba, Mg, Ca or Zn. At least one phase is activated with divalent europium ($Eu^{2+}$) and at least one of the phases contains a dopant D comprising F, Cl, Br, S or N. It is believed that at least some of the dopant atoms are located on oxygen atom lattice sites of the host silicate crystal.

US2007/0029526 discloses a silicate-based orange phosphor having the formula $(Sr_{1-x}M_x)_yEu_zSiO_5$ in which M is at least one of a divalent metal comprising Ba, Mg, Ca or Zn; $0<x<0.5$; $2.6<y<3.3$; and $0.001<z<0.5$. The phosphor is configured to emit visible light having a peak emission wavelength greater than about 565 nm.

The phosphor can also comprise an aluminate-based material such as is taught in our co-pending patent application US2006/0158090 and U.S. Pat. No. 7,390,437 (also assigned to Intematix Corporation) or an aluminum-silicate phosphor as taught in co-pending application US2008/0111472 the content of each of which is hereby incorporated by way of reference thereto.

US2006/0158090 teaches an aluminate-based green phosphor of formula $M_{1-x}Eu_xAl_yO_{[1+3y/2]}$ in which M is at least one of a divalent metal comprising Ba, Sr, Ca, Mg, Mn, Zn, Cu, Cd, Sm or thulium (Tm) and in which $0.1<x<0.9$ and $0.5\leqq y\leqq 12$.

U.S. Pat. No. 7,390,437 discloses an aluminate-based blue phosphor having the formula $(M_{1-x}Eu_x)_{2-z}Mg_zAl_yO_{[2+3y/2]}$ in which M is at least one of a divalent metal of Ba or Sr. In one composition the phosphor is configured to absorb radiation in a wavelength ranging from about 280 nm to 420 nm, and to emit visible light having a wavelength ranging from about 420 nm to 560 nm and $0.05<x<0.5$ or $0.2<x<0.5$; $3\leqq y\leqq 12$ and $0.8\leqq z\leqq 1.2$. The phosphor can be further doped with a halogen dopant H such as Cl, Br or I and be of general composition $(M_{1-x}Eu_x)_{2-z}Mg_zAl_yO_{[2+3y/2]}$:H.

US2008/0111472 teaches an aluminum-silicate orange-red phosphor with mixed divalent and trivalent cations of general formula $(Sr_{1-x-y}M_xT_y)_{3-m}Eu_m(Si_{1-z}Al_z)O_5$ in which M is at least one divalent metal selected from Ba, Mg or Ca in an amount ranging from $0\leqq x\leqq 0.4$; T is a trivalent metal selected from Y, lanthanum (La), Ce, praseodymium (Pr), neodymium (Nd), promethium (Pm), samarium (Sm), gadolinium (Gd), terbium (Tb), dysprosium (Dy), holmium (Ho), Erbium (Er), Tm, ytterbium (Yt), lutetium (Lu), thorium (Th), protactinium (Pa) or uranium (U) in an amount ranging from $0\leqq y\leqq 0.4$ and z and m are in a range $0\leqq z\leqq 0.2$ and $0.001\leqq m\leqq 0.5$. The phosphor is configured such that the halogen resides on oxygen lattice sites within the silicate crystal.

It will be appreciated that the phosphor is not limited to the examples described herein and can comprise any phosphor material including both organic or inorganic phosphors such as for example nitride and/or sulfate phosphor materials, oxy-nitrides and oxy-sulfate phosphors or garnet materials (YAG).

Optionally, the lighting device 10 additionally comprises an annular lens array 32 for focusing, diffusing or otherwise directing light 34 emitted by the device in a desired pattern/angular distribution. The lens array 32 has been removed in FIG. 1 to make the configuration of the LED devices 24 visible. The lens array 32 is generally annular in form and has a central circular aperture corresponding to the circular opening 18 in the base of the body to allow substantially free passage of air through the opening 18. Referring to FIG. 2 the lens array 32 comprises an annular array of lens elements 32*a* in which each lens element 32*a* overlies a respective LED device 24. In the embodiment illustrated each lens element 32*a* is generally convex in a radial direction and generally concave in a circumferential direction that is the surface of each lens element comprises a "saddle" surface (hyperbolic paraboloid). It will be appreciated that the lens array 32 is configured in dependence on a desired light emission pattern and in other configurations it is contemplated that each lens element 32*a* can be convex or concave in both radial and circumferential directions. Moreover, the lens array can further include a layer of light diffusing material on its surface or particles of the light diffusing material incorporated in the lens array material such that it is substantially uniformly distributed throughout the volume of the lens array. Examples of suitable light diffusing materials include silicon dioxide ($SiO_2$), magnesium oxide (MgO) and barium sulfate ($BaSO_4$) with a particle size of 100 to 200 nm.

Operation of the lighting device 10 will now be described with reference to FIG. 4 which is a schematic cross-sectional view through the plane A-A of the lighting device 10 of FIG. 1. In FIG. 4 the lighting device 10 is shown in a first orientation of operation in which the light emitting face of the device (base of the body) is directed in a downward direction as would be the case for example when using the device in a pendant-type fixture suspended from a ceiling. In operation heat generated by the LED devices 24 is conducted into the base of the thermally conducting body 12 and is then conducted through the body to the exterior surfaces of the body and the interior surface of the cavity 16 where it is then radiated into the surrounding air. The radiated heat is convected by the surrounding air and the heated air rises (i.e. in a direction towards the connector cap in FIG. 4) to establish a movement (flow) of air through the device as indicated by solid arrows 36 in FIG. 4. In a steady state air is drawn into the device through the circular opening 18 by relatively hotter air rising in the cavity 16, the air absorbs heat radiated by the wall of the cavity and rises up through the cavity 16 and out through the passages 20. Additionally, warm air that rises over the outer surface of the body and passes over the passage openings will further draw air through the device. Together the cavity 16 and passages 20 operate in a similar manner to a chimney (flue) in which, by the "chimney effect", air is in drawn in for combustion by the rising of hot gases in the flue.

Configuring the walls of the cavity 16 and the passages 20 such that they extend in a generally upward direction (i.e. relative to a line that is parallel to the axis of the body) promotes a flow of air through the device by increasing the "chimney effect" and thereby increasing cooling of the device. It will be appreciated that in this mode of operation the circular opening 18 acts as an air inlet and the passages 20 act as exhaust ports.

The ability of the body 12 to dissipate heat, that is its heat sink performance, will depend on the body material, body geometry, and overall surface heat transfer coefficient. In general, the heat sink performance for a forced convection heat sink arrangement can be improved by (i) increasing the thermal conductivity of the heat sink material, (ii) increasing the surface area of the heat sink and (iii) increasing the overall area heat transfer coefficient, by for example, increasing air flow over the surface of the heat sink. In the lighting device 10 of the invention the cavity 16 increases the surface area of the body thereby enabling more heat to be radiated from the body. For example in the embodiment described the cavity is generally conical in form and typically has a diameter in a range 20 mm to 30 mm and a height in a range 45 mm to 80 mm, that is the cavity has a surface area in a range of about 1,000 $mm^2$ to 3,800 $mm^2$ which represents an increase in heat emitting surface area of up to about 30% for a device having dimensions generally corresponding with an incandescent light bulb (i.e. axial body length 65 to 100 mm and body diameter 60 to 80 mm). As well as increasing the heat emitting surface area, the cavity 16 also reduces a variation in the heat sink performance of each LED device. Arranging the LED devices around the opening to the cavity reduces the length of the thermal conduction path from each device to the nearest heat emitting surface of the body and promotes a more uniform cooling of the LED devices. In contrast, in an arrangement that does not include a central cavity and in which the LED devices are arranged as an array, heat generated by devices at the center of the array will have a longer thermal conduction path to a heat emitting surface than that of heat generated by devices at the edges of the array resulting in a lower heat sink performance for LEDs at the center of the array. In selecting the size of the cavity a balance between maximizing the overall heat emitting surface area of the body and not substantially decreasing the thermal mass of the body needs to be achieved.

Although the cavity increases the heat emitting surface area of the body the cavity could trap heated air and give rise to a buildup of heat within the cavity when the device is operated with the face/opening oriented in a downward direction were it not for the passages 20. The passages 20 allow the escape of heated air from the cavity and in doing so establish a flow of air in to the cavity through the circular opening and out of the passages and thereby increase the heat transfer coefficient of the body. It will be appreciated that the passages 20 provide a form of passive forced heat convection. Consequently the cavity and passage(s) can collectively be considered to comprise a flue. Moreover, it will be appreciated that the angle θ of inclination of the cavity wall and/or passage walls will affect the rate of air flow and consequently heat transfer coefficient. For example if the walls are substantially vertical the "chimney effect" is maximized since there is minimal resistance to air flow but though there will be a lower heat transfer to the moving air. Conversely, the more inclined the walls the greater resistance they present to air flow and the more heat is transferred to the moving air. Since in many applications it will be required to be able to operate the device in many orientations including those in which the axis of the body is not vertical, the passage(s) preferably extend in a direction of about 45° to a line that is parallel to the axis of the body such that a flow of air will occur regardless of the orientation of the device. The geometry, size and angle of inclination of the walls of the cavity and passages are preferably selected to optimize cooling of the body using a computation fluid dynamics (CFD) analysis. It is contemplated that by appropriate configuration of the passages 20 an increase of heat sink performance of up to 30% may be possible. Preliminary calculations indicate that the inclusion of a cavity in conjunction with the passages can give rise to an increase in heat sink performance of between 15% and 25%.

Examples of various passage configurations are illustrated in FIGS. 5(*a*) to (*d*) which respectively show schematic sectional representations of a thermally conducting body with passages that extend at an angle θ of (a) 45°, (b) 90°, (c) 0° and (d) 10° and 30°. In FIG. 5(*a*) the thermally conducting body 12 is frustconical in form and has a coaxial conical cavity 16. Sixteen circular passages 20 are grouped in four groups of four with each passage 20 extending in a generally radial direction in a direction away from the base of the body in a generally upwardly extending direction. As illustrated the angle of inclination θ of the passages is about 45° and is measured relative to a line that is parallel to the axis of the body and which passes through the center of the passage where the passage meets the cavity. A 45° angle of inclination of the passages is preferred for devices which may be operated at many different angles of orientation.

In other embodiments and as is illustrated in FIG. 5(*b*) the passages can have an angle of inclination θ of 90° such that each extends in a radial direction. Such an angle of inclination may be preferred for devices where it is known that the device will be operated in a horizontal orientation. As is illustrated in FIG. 5(*c*) the passages can also have an angle of inclination θ of 0° such that each extends in a direction that is parallel with the axis of the body. Such an angle of inclination is preferred for devices where it is known that the device will be operated in a vertical orientation since a vertically extending passage will maximize the chimney effect. In other embodiments the passages can have other angles of inclination θ and can comprise passages with differing angles of inclination. FIG. 5(*d*) illustrates an example of such a configuration which has two groups of passages having respective angles of inclination of $\theta_1$=10° and $\theta_2$=30°. In summary it will be appreciated that the angle of inclination θ of the passages 20 can be selected to be from 0° to 90° depending on the configuration of the body/cavity and intended application and will typically be in a range 30° to 60° and preferably about 45° to enable operation of the device in any orientation.

Figure 6:
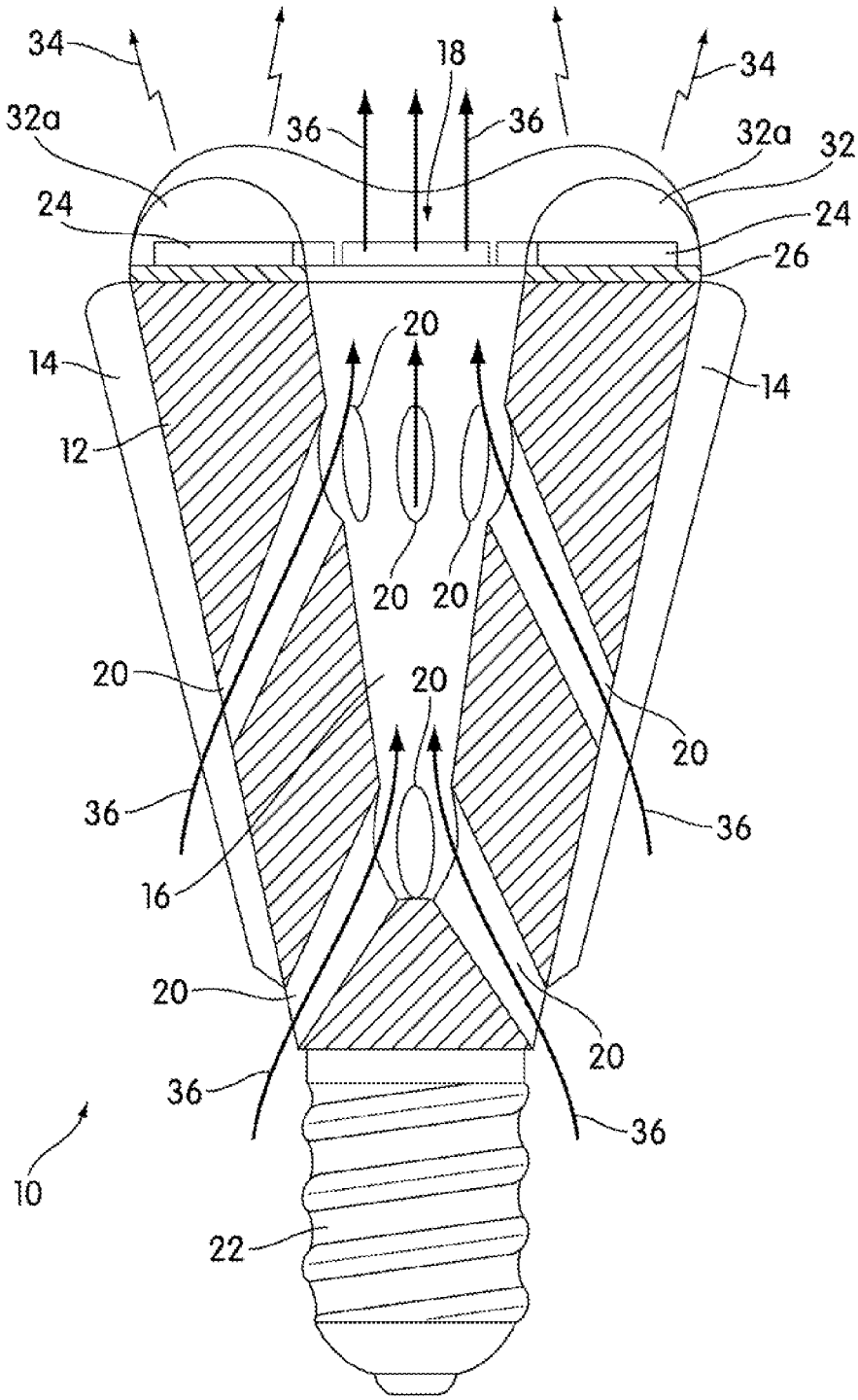
FIG. 6 is a schematic sectional representation of the LED lighting device of FIG. 1 through a plane A-A for a second orientation of operation.

Referring to FIG. 6 operation of the lighting device 10 is now described for a second orientation of operation in which the light emitting face of the device is directed in an upward direction as would be the case for example when using the device in a up-lighting fixture such as a table, desk or floor standing lamp. In operation heat generated by the LED devices 24 is conducted into the base of the thermally conducting body 12 and is then conducted through the body to the exterior surface of the body and the interior surface of the cavity where it is radiated into the surrounding air. Heat that is radiated within the cavity 16 heats air within the cavity and the heated air rises (i.e. in a direction away from the connector cap in FIG. 6) to establish a flow of air through the device as indicated by solid arrows 36 in FIG. 5. In a steady state cooler air is drawn into the device through the passages 20 by the relatively hotter air rising in the cavity 16, the air absorbs heat radiated by the walls of the passage and cavity and rises up through the cavity 16 and out of the circular opening 18. In this mode of operation the passages 20 act as air inlets and the circular cavity opening acts as an exhaust port.

A white light emitting LED lighting device 10 in accordance with a second embodiment of the invention will now be described with reference to FIGS. 7 and 8. The LED lighting device 10 is configured for operation with a 110V (r.m.s.) AC (60 Hz) mains power supply and is intended as a direct replacement for a halogen lamp.

Figure 7:
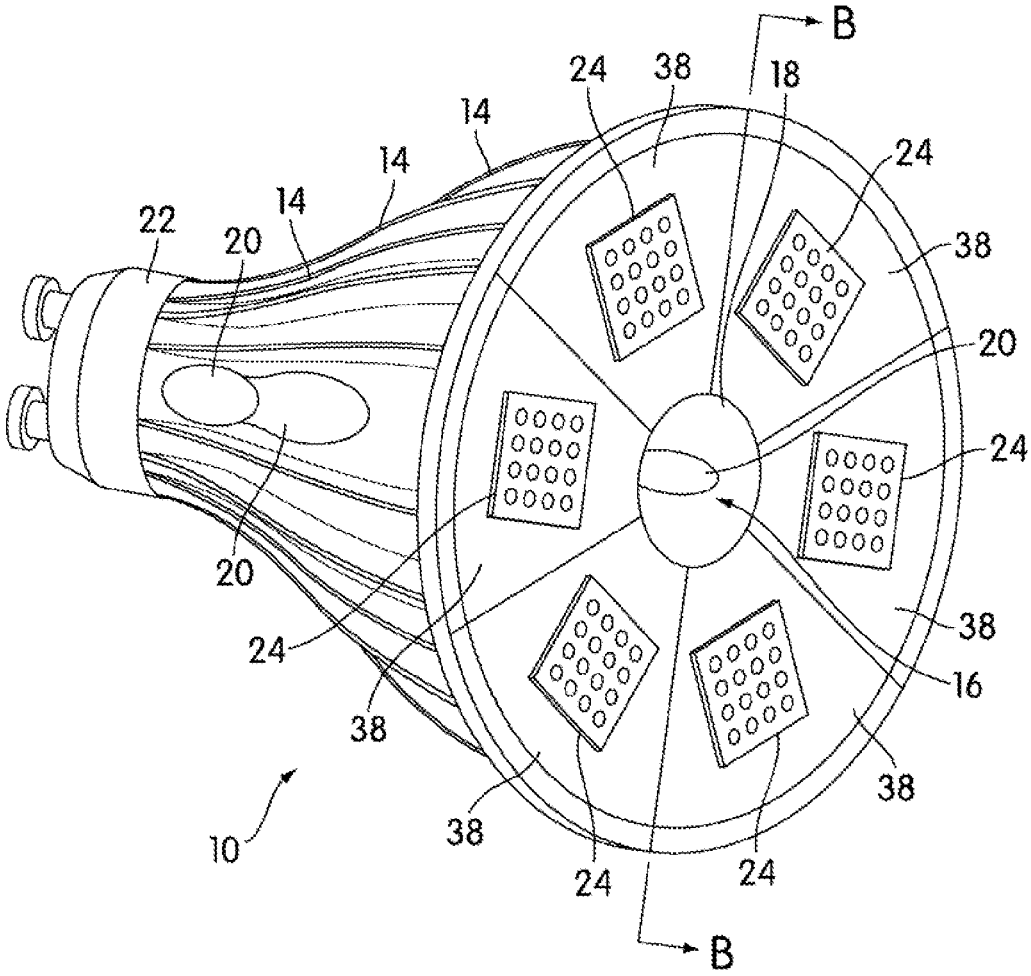
FIG. 7 is a schematic sectional representation of an LED lighting device in accordance with a second embodiment of the invention.
Figure 8:
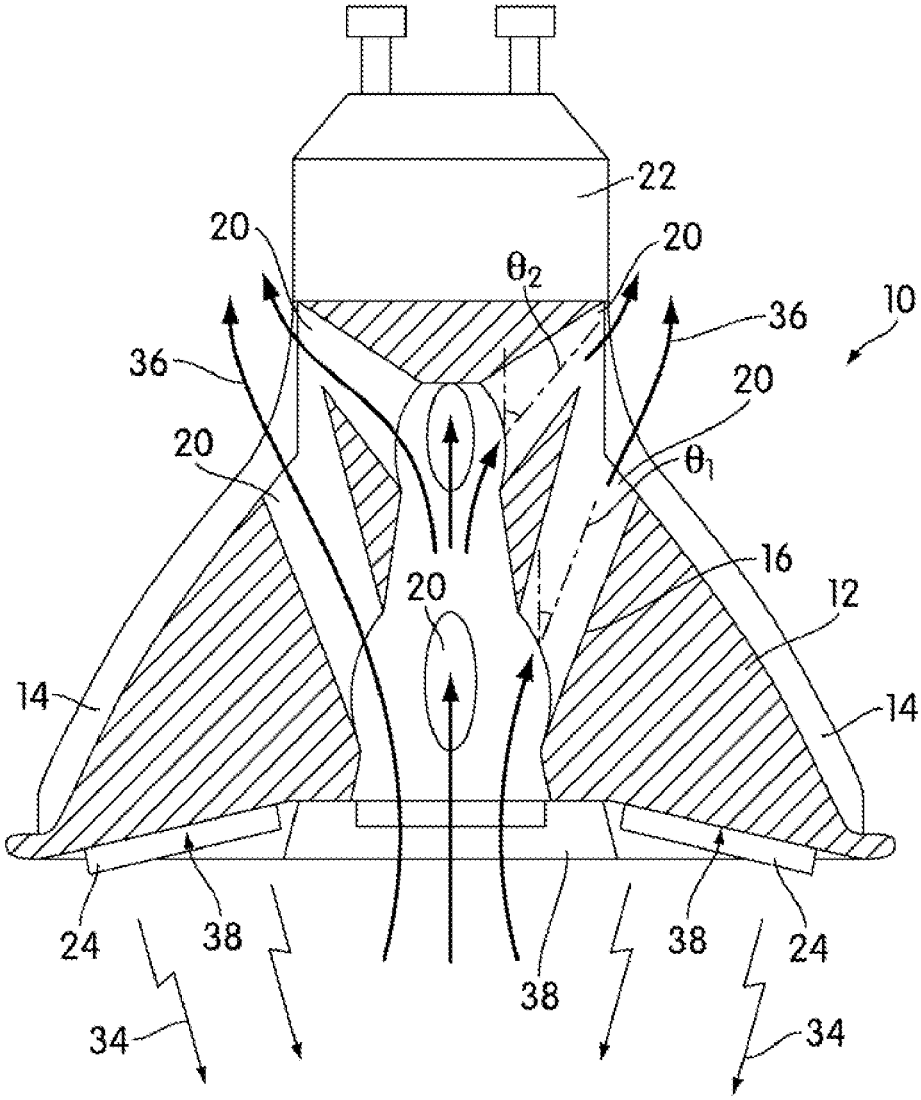
FIG. 8 is a schematic sectional representation of the LED lighting device of FIG. 7 through a plane B-B.

FIG. 7 is a perspective representation of the LED lighting device 10 and comprises a generally frustoconical thermally conducting body 12 having a plurality of latitudinal heat radiating fins (veins) 14 circumferentially spaced around its outer curved surface. The form factor of the body 12 is configured to resemble a standard MR-16 (MR16) body shape enabling the device to be used directly in existing lighting fixtures. The body is made of a material with a high thermal conductivity, that is a thermal conductivity of typically ≧150 $Wm^{-1}K^{-1}$ and preferably ≧200 $Wm^{-1}K^{-1}$, such as for example aluminum, anodized aluminum, an alloy of aluminum, a magnesium alloy, a metal loaded plastics material or a thermally conductive ceramic. In this embodiment the base of the body is concave and is multifaceted with six sector-shaped faces 38, each of which is directed towards the axis of the body.

A coaxial substantially conical cavity (bore) 16 extends into the body 12 from a circular opening 18 in the base of the body. Referring to FIG. 8, eight tapering passages (conduits) 20 connect the cavity 16 to the outer surface of the body. The passages 20 are grouped in two groups of four with a first group located in proximity to the base of the body and a second group located near the apex of the body. The passages are circumferentially spaced and each passage 20 extends in a generally radial direction and is inclined at an angle θ to a line that is parallel to the axis of the body in a direction away from the base of the body. In FIG. 8 passages of the first group have an angle of inclination $\theta_1$ of order 15° whilst passages of the second group have an angle of inclination $\theta_2$ of order 40°. Since the passages of the two groups have different angles of inclination $\theta_1$ $\theta_2$ corresponding passages 20 from each group converge to form a single opening on the outer surface of the thermally conducting body near the connector base. The passages 20 promote a flow of air through the body to provide cooling of the device. To further aid in the dissipation of heat the passages 20 and/or cavity 16 preferably include a series of heat radiating fins though for simplicity these are not illustrated in the accompanying figures. For ease of fabrication the body 12 is preferably die cast or molded.

The device further comprises a GU10 "turn and lock" connector base 22 enabling the device to be connected directly to a mains power supply with a standard socket. It will be appreciated that depending on the intended application other connector bases can be used such as, for example bayonet or screw-type connector bases. The connector base 22 is mounted to the apex of the body 12.

A respective LED device 24 is mounted in thermal communication with an associated face 38 on the base of the body 12 such that the devices are substantially equally spaced around the opening. Configuring the base to be concave and multifaceted ensures that the device 10 produces a substantially convergent light emission 34 that is similar to the emission pattern of a conventional halogen reflector lamp.

Rectifier circuitry for enabling the lighting device 10 to be operated directly from a mains power supply can be housed within the connector cap 22. Electrical power is supplied to the LED devices 24 by connecting wires that run through conduits (not shown) that pass through the body between the base and the apex.

Operation of the lighting device 10 is analogous to that of the lighting device of FIGS. 1 to 3 and will now be described with reference to FIG. 8 which is a schematic cross-sectional view through the plane B-B of the lighting device 10 of FIG. 7. In FIG. 8 the lighting device 10 is shown in an orientation of operation in which the light emitting face of the device is directed in a downward direction as would be the case for example when using the device as a ceiling mounted spotlight. In operation heat generated by the LED devices 24 is conducted into the faces 38 of the thermally conducting body 12 and is then conducted through the body to the exterior surface of the body and the interior surface of the cavity where it is radiated into the surrounding air. The radiated heat is convected by the surrounding air and the heated air rises (i.e. in a direction toward the connector base in FIG. 8) to establish a flow of air through the device as indicated by solid arrows 36. In a steady state cooler air is drawn into the device through the circular opening 18 by the relatively hotter air rising in the cavity 16, the cooler air absorbs heat radiated by the wall of the cavity and rises up through the cavity 16 and out of the passages 20. The cavity and passages collectively promote a flow of air through the device to increase cooling of the device. As illustrated in FIG. 7 the circular opening 18 acts as an air inlet and the passages 20 act as exhaust ports.

A white light emitting LED lighting device 10 in accordance with a third embodiment of the invention will now be described with reference to FIGS. 9 and 10. The LED lighting device 10 is configured for operation with a 240V (r.m.s.) AC (50 Hz) mains power supply and is intended as a direct replacement for a incandescent light bulb.

Figure 9:
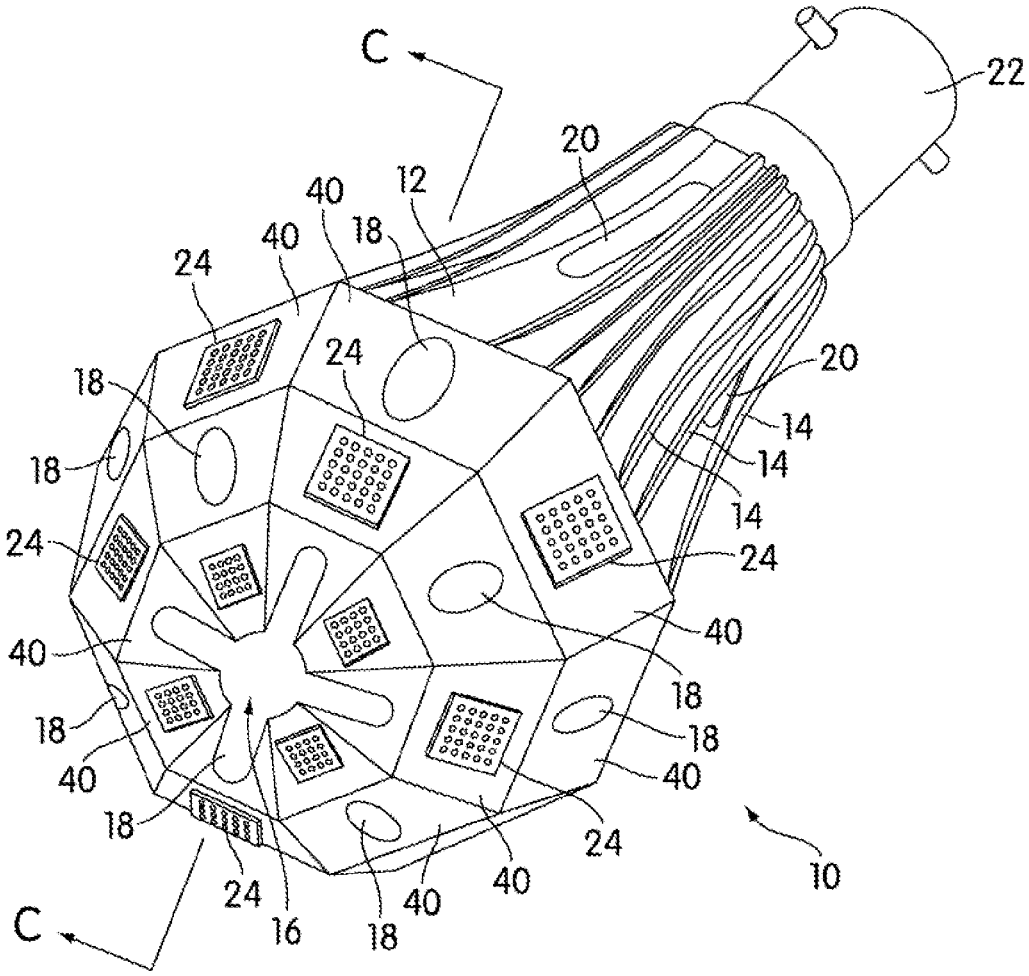
FIG. 9 is a schematic sectional representation of an LED lighting device in accordance with a third embodiment of the invention.

FIG. 9 is a perspective representation of the LED lighting device 10 and comprises a thermally conducting body 12 that is configured such that its outer surface has a form factor that resembles the envelope (bulb) of a standard incandescent light bulb enabling the device to be used directly in existing lighting fixtures. The body is fabricated of a material with a high thermal conductivity (typically $\geqq 150\ Wm^{-1}K^{-1}$, preferably $\geqq 200\ Wm^{-1}K^{-1}$) such as for example aluminum, anodized aluminum, an alloy of aluminum, a magnesium alloy, a metal loaded plastics material or a thermally conductive ceramic. In this embodiment the outer surface of the body is multifaceted and has twenty four faces 40 that comprise a substantially hemispherical end surface.

A coaxial substantially ellipsoidal cavity (bore) 16 within the body 12 is connected to alternate faces 40 of the body by a respective one of eight openings 18 and to an end of the body by a ninth substantially circular axial opening 18. The four openings in the end faces 40 are generally slot shaped in form and in conjunction with the circular opening form a cross shaped opening.

Figure 10:
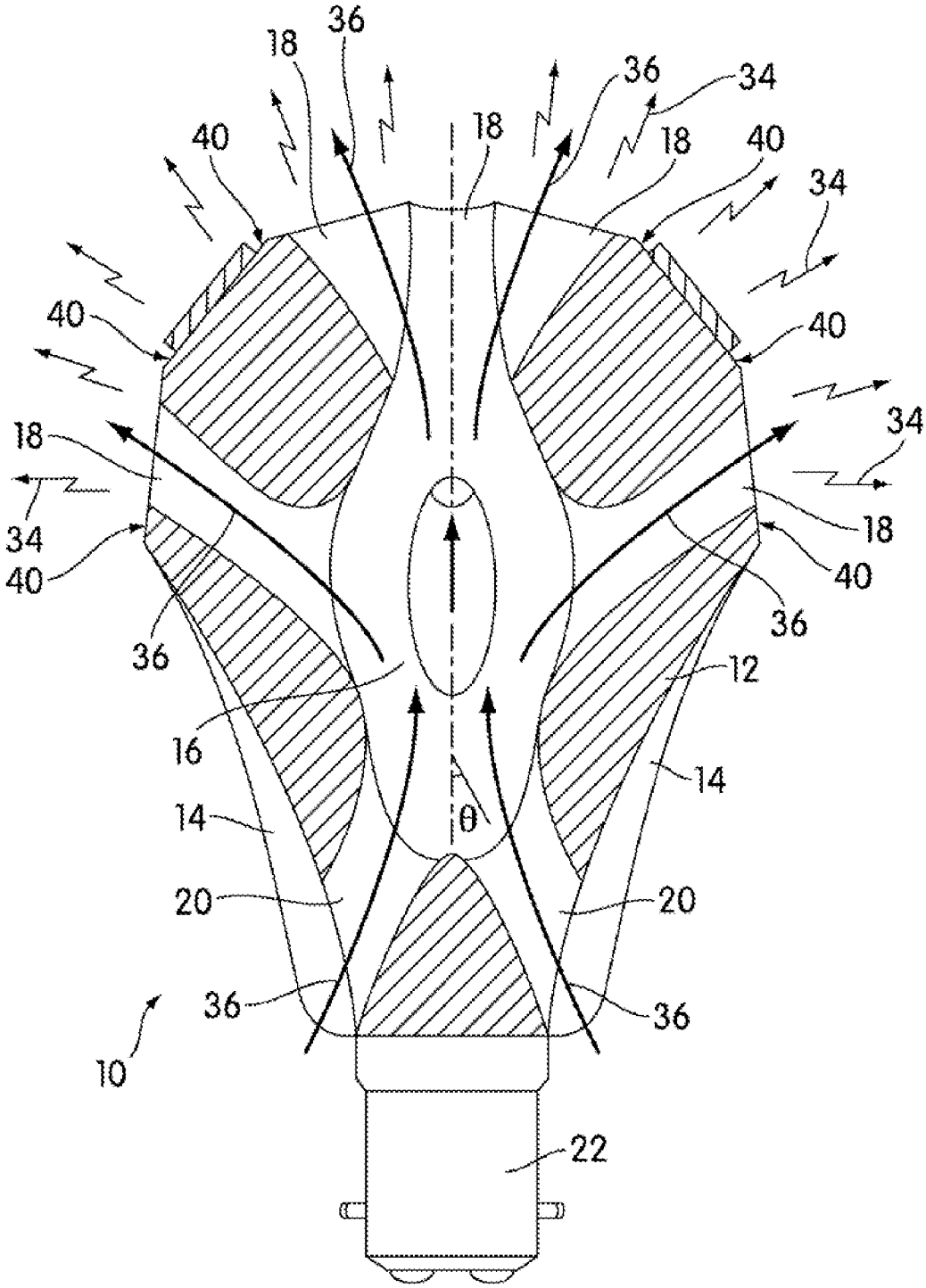
FIG. 10 is a schematic sectional representation of the LED lighting device of FIG. 9 through a plane C-C.

Referring to FIG. 10, four passages (conduits) 20 connect the cavity 16 to the outer surface of the body in the vicinity of a connector cap 22. The passages are circumferentially spaced and each passage 20 extends in a generally radial direction and is inclined at an angle θ of 20° and 60° to a line that is parallel with the axis of the body in direction towards and away from the connector cap. The passages 20 enable air to flow through the body to provide cooling of the device. A plurality of latitudinal heat radiating fins (veins) 14 circumferentially spaced around the outer curved surface of the body extend between the connector cap 22 and the faces 40. To further aid in the dissipation of heat the passages 20 and/or cavity 16 preferably include a series of heat radiating fins though for simplicity these are not illustrated in the accompanying figures. For ease of fabrication the body 12 is preferably die cast or molded.

The device further comprises a double contact bayonet connector cap 22 (e.g. B22d or BC) enabling the device to be connected directly to a mains power supply with a standard bayonet light socket. It will be appreciated that depending on the intended application other connector bases can be used such as, for example screw-type connector caps. The connector cap 22 is mounted to the body 12.

Twelve LED devices 24 are mounted in thermal communication on the remaining alternate faces 40 of the body 12 (that is the faces that do not include an opening). It will be appreciated that although the device has nine openings to the cavity the LED devices are still configured around each opening. By configuring the body to be convex and multifaceted this ensures that the device 10 produces a substantially divergent light emission 34 that generally resembles the light emission of a conventional incandescent bulb.

Rectifier circuitry for enabling the lighting device 10 to be operated directly from a mains power supply can be housed within the connector cap 22. Electrical power is supplied to the LED devices 24 by connecting wires that run through conduits (not shown) that pass through the body connecting the connector cap to the faces 40.

Operation of the lighting device 10 is analogous to that of the lighting device of FIGS. 1 to 3 and FIG. 7 and will now be briefly described with reference to FIG. 10 which is a schematic cross-sectional view through the plane C-C of the lighting device 10 of FIG. 9. In FIG. 10 the lighting device 10 is shown in an orientation of operation in which the connector cap 22 is directed in a downward direction as would be the case for example when using the device in a table or floor standing lamp. In operation heat generated by the LED devices 24 is conducted into the faces 40 of the thermally conducting body 12 and is then conducted through the body to the exterior surface of the body and the interior surface of the cavity where it is radiated into the surrounding air. The radiated heat is convected by the surrounding air and the heated air rises (i.e. in a direction away from the connector cap in FIG. 10) to establish a flow of air through the device as indicated by solid arrows 36. In a steady state cooler air is drawn into the device through the passages 20 by the relatively hotter air rising in the cavity 16, the cooler air absorbs heat radiated by the wall of the cavity and rises up through the cavity 16 and out of the openings 18. The cavity and passages collectively promote a flow of air through the device to increase cooling of the device. As illustrated in FIG. 10 the passages 20 acts as an air inlets and the openings 18 act as exhaust ports.

A white light emitting LED lighting device 10 in accordance with a fourth embodiment of the invention will now be described with reference to FIGS. 11 and 12. The LED lighting device 10 is configured for 12V operation and is intended as a direct replacement for a halogen reflector lamp.

Figure 11:
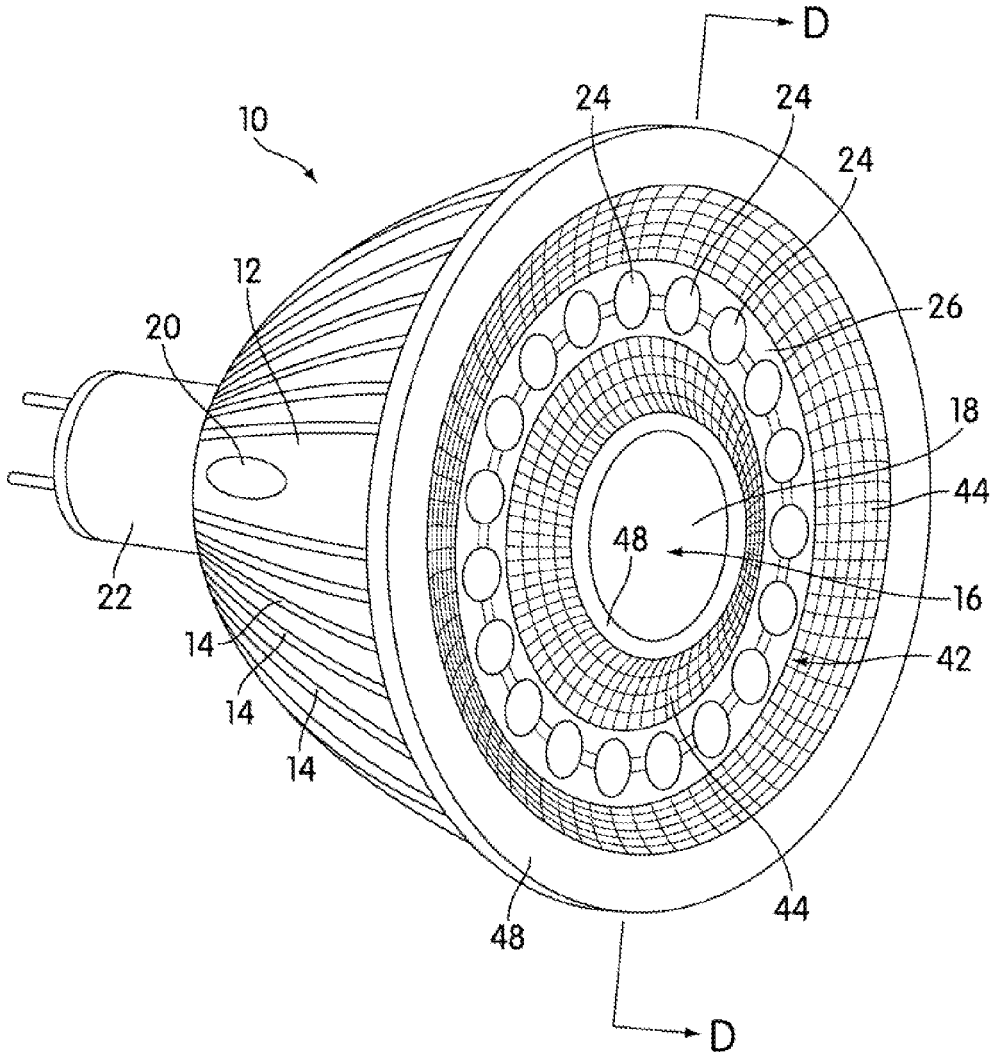
FIG. 11 is a schematic sectional representation of an LED lighting device in accordance with a fourth embodiment of the invention.
Figure 12:
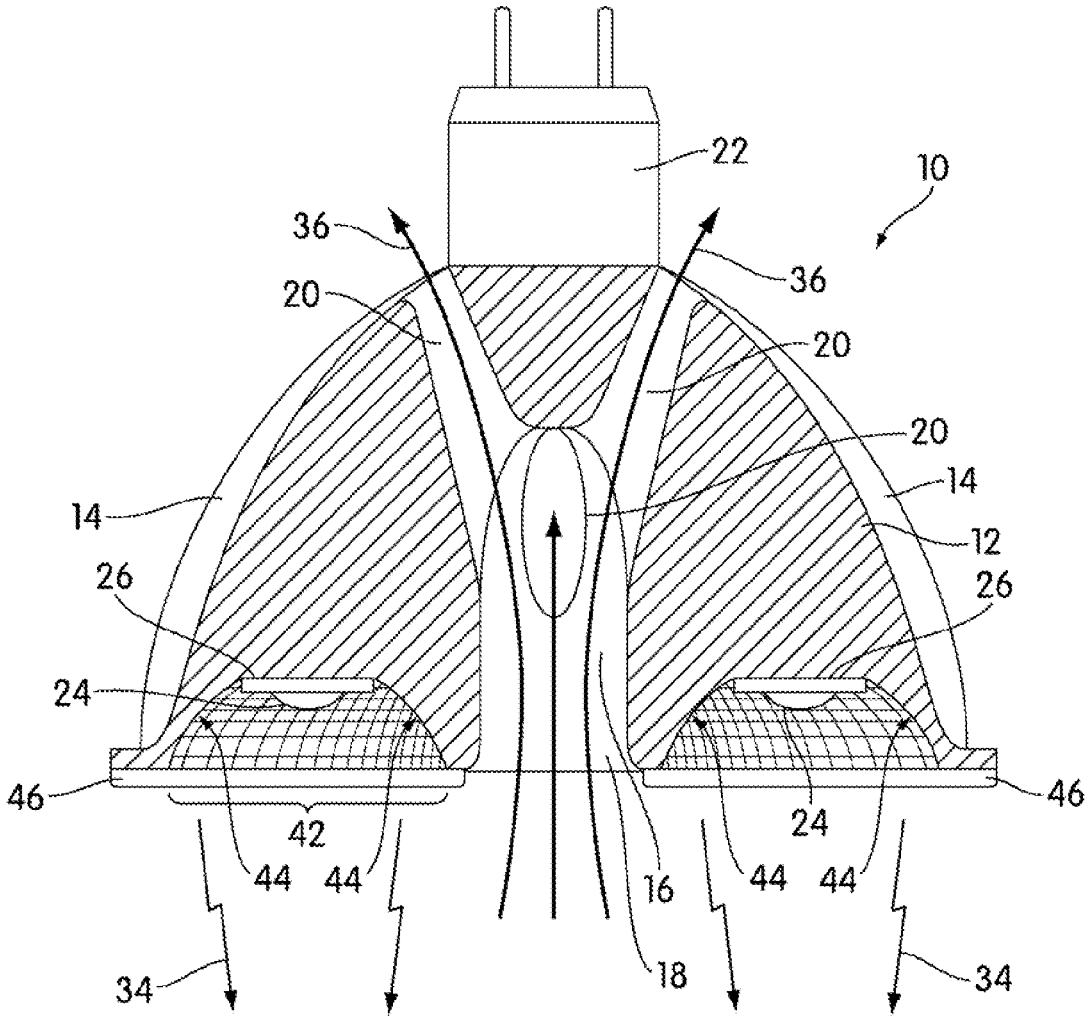
FIG. 12 is a schematic sectional representation of the LED lighting device of FIG. 11 through a plane D-D.

FIG. 11 is a perspective representation of the LED lighting device 10 and comprises a thermally conducting body 12 that is configured such that its outer surface has a form factor that resembles a standard MR-16 (MR16) body shape enabling the device to be used directly in existing lighting fixtures/holders. In other embodiments the body 12 is configured such that its outer surface has a form factor resembling an MR-11 (MR11). The body is made of a material with a high thermal conductivity, that is a thermal conductivity of typically $\geqq 150$ $Wm^{-1}K^{-1}$ and preferably $\geqq 200$ $Wm^{-1}K^{-1}$, such as for example aluminum, anodized aluminum, an alloy of aluminum, a magnesium alloy, a metal loaded plastics material or a thermally conductive ceramic. The body can further comprise a plurality of latitudinal heat radiating fins (veins) 14 circumferentially spaced around its outer curved surface.

In this embodiment the base of the body includes an annular channel 42 with a flat floor and walls 44 that are configured such as to form an annular parabolic reflector. The walls 44 are preferably coated with a light reflecting material and can, as illustrated, be multifaceted as opposed to a continuous smooth curved surface.

A coaxial substantially conical cavity (bore) 16 extends into the body 12 from a circular opening 18 in the base of the body. Referring to FIG. 11, four passages (conduits) 20 connect the cavity 16 to the outer surface of the body. The passages 20 are circumferentially spaced and each passage 20 extends in a generally radial direction and is inclined at an angle θ of about 15° to a line that is parallel with the axis of the body in a direction away from the base of the body. The passages 20 and cavity 16, by the "chimney effect", promote a flow of air through the body to provide cooling of the device. To further aid in the dissipation of heat the passages 20 and/or cavity 16 preferably include a series of heat radiating fins though for simplicity these are not illustrated in the accompanying figures. For ease of fabrication the body 12 is preferably die cast or molded.

The device further comprises a GU5.3 or GX5.3 bipin (2-pin) connector base 22 enabling the device to be connected directly to a 12V power supply using a standard bipin socket. The connector base 22 is mounted to the apex of the body 12.

An annular array of LED device 24 mounted on an annular shaped MCPCB 26 which is mounted in thermal communication with the floor of the annular channel 42. Mounting the LED devices on the floor of the annular reflector channel 42 ensures that the device 10 produces a light emission 34 with a selected emission profile, for example, an emission profile similar to the emission pattern of a conventional halogen reflector lamp most commonly 10°, 15°, 25° and 40° beam angles.

Electrical power is supplied to the LED devices 24 by connecting wires that run within conduits (not shown) that pass through the body between the base and the apex. Protection circuitry for protecting the LED devices 24 against power surges, voltage fluctuations etc. can be housed within the connector cap 22.

Optionally, the lighting device 10 can further comprise a transparent annular front cover 46 (not shown in FIG. 11) mounted to the annular faces 48 on the base of the body 12. The front cover 46 can be used to provide environmental protection of the LED devices 24 and the reflective walls 44 of the annular reflector. In other embodiments it is contemplated to incorporate one or more phosphor materials within the front cover to generate a desired color and/or CCT (Correlated Color Temperature) of emitted light 34.

Operation of the lighting device 10 is analogous to that of the lighting device of FIGS. 1 to 3, 7 and 9, and will now be described with reference to FIG. 12 which is a schematic cross-sectional view through the plane D-D of the lighting device 10 of FIG. 11. In FIG. 12 the lighting device 10 is shown in an orientation of operation in which the light emitting face of the device is directed in a downward direction as would be the case for example when using the device as a ceiling mounted spotlight. In operation heat generated by the annular array of LED devices 24 is conducted into the floor of the annular channel 42 and is then conducted through the thermally conducting body to the exterior surface of the body and the interior surface of the cavity where it is radiated into the surrounding air. The radiated heat is convected by the surrounding air and the heated air rises (i.e. in a direction toward the connector base in FIG. 12) to establish a flow of air through the device as indicated by solid arrows 36. In a steady state cooler air is drawn into the device through the circular opening 18 by the relatively hotter air rising in the cavity 16, the cooler air absorbs heat radiated by the wall of the cavity and rises up through the cavity 16 and out of the passages 20. The cavity 16 and passages 20 collectively, by the "chimney effect" promote a flow of air through the device to increase cooling of the device. As illustrated in FIG. 11 the circular opening 18 acts as an air inlet and the passages 20 act as exhaust ports.

It will be appreciated that the present invention is not restricted to the specific embodiments described and that variations can be made that are within the scope of the invention. For example, in other embodiments the cavity and passages can comprise other forms such as being helical to promote air to flow in a vortex within the cavity. Moreover, the fins on the outer surface of the body can spiral around the body such that they present a larger surface area to passing air.

Other geometries will be readily apparent to those skilled in the art and can include for example thermally conducting bodies that are substantially cylindrical or substantially hemispherical depending on an intended application. Moreover, the body can include more than one cavity in which each cavity has a respective opening or share one or more common openings.

Although it is preferred to use a separate rectifier circuit to drive the LED devices it will be appreciated that in other implementations the plurality of LED devices can be connected in a self-rectifying configuration such as for example is described in co-pending U.S. application Ser. No. 12/127,749 filed May 27, 2008.

In the examples described the phosphor material is provided as an encapsulation within each recess of the LED package. In other embodiments a separate layer of phosphor-containing material is provided overlying each of the recesses. Preferably, the layer of phosphor-containing material is fabricated as a separate sheet which is then cut into appropriately sized pieces that can then be bonded onto the face on the LED device package with for example a light transmissive (transparent) adhesive such as optical quality epoxy or silicone. In such an arrangement each recess of the LED device is preferably filled with a transparent material such as to cover and encapsulate each LED chip. The transparent material constitutes a passivation coating of the LED chip thereby providing environmental protection of the LED chip and bond wires. Additionally, the transparent material acts as a thermal barrier and reduces the transfer of heat to the overlying phosphor layer. The phosphor material(s), which is/are in powder form, is/are mixed in pre-selected proportions with a transparent polymer material such as for example a polycarbonate material, an epoxy material or a thermosetting or UV curable transparent silicone. The weight ratio loading of phosphor mixture to silicone can typically be in a range 35 to 65 parts per 100 with the exact loading depending on the target correlated color temperature (CCT) or color hue of the device. The phosphor/polymer mixture is then extruded to form a homogeneous phosphor/polymer sheet with a uniform distribution of phosphor throughout its volume. As with the weight loading of the phosphor to polymer, the thickness of the phosphor layer (phosphor/polymer sheet) will depend on the target CCT and/or color hue of the finished device.

Alternatively, in a further arrangement it is contemplated to provide the phosphor material on a face of the lens array or front cover, preferably the substantially planar face facing the LED devices 24. Providing the phosphor separately to the LED devices offers a number of advantages compared with an LED device in which individual recess are potted with a phosphor containing material, namely:

- a reduction in manufacturing costs since a single LED device can be used to generate a required CCT and/or color hue of light by overlaying an appropriate sheet of phosphor containing material;
- a more consistent CCT and/or color hue; and
- a reduction in thermal degradation of the phosphor since the phosphor is located remote to the LED chip.

What is claimed is:

1. A light emitting diode lighting device comprising:

a thermally conducting body having at least one opening that connects with at least one cavity within the body, wherein the thermally conducting body is symmetric with a central axis;

a plurality of light emitting diodes mounted in thermal communication with a face of the body and positioned around the opening;

at least one passage passing through the body from the cavity to an outer surface of the body and configured such that in operation air moves through the at least one cavity by thermal convection thereby to provide cooling of the body; and a plurality of heat radiating fins extending from an internal surface of the at least one passage and the cavity to aid in dissipation of heat.

2. The device of claim 1, wherein the at least one passage is configured such that it extends in a direction from an axis of the body to the outer surface of the body away from the face.

3. The device of claim 2, wherein the at least one passage extends in a direction at an angle to a line parallel with the axis of the body that is selected from the group consisting of: 30° to 60°; and about 45°, in order to optimize cooling of the body for different operation orientation of the lighting device.

4. The device of claim 1, wherein the body is selected from the group consisting of being: substantially a frustum of a cone and the base comprises the face on which the LEDs are mounted; and substantially cylindrical in form, and the at least one cavity is selected from the group consisting of being: substantially conical; substantially a frustum of a cone; and substantially cylindrical in form.

5. The device of claim 1, wherein the body is configured such that its outer surface has a form factor selected from the group consisting of: resembling the envelope of an incandescent light bulb; resembling an MR-16 halogen reflector lamp; and resembling an MR-11 halogen reflector lamp.

6. The device of claim 1, wherein the face is multifaceted and a respective LED is mounted on each face.

7. The device of claim 1, and comprising a plurality of passages connecting the at least one cavity to the outer surface of the body.

8. The device of claim 7, wherein the plurality of passages is selected from the group consisting of being circumferentially spaced; axially spaced; and a combination thereof.

9. The device of claim 1, wherein the body further comprises a plurality of heat radiating fins extending from the outer surface of the body.

10. The device of claim 1, wherein the body is made of a material selected from the group consisting of: a material having a thermal conductivity≧150 $Wm^{-1}K^{-1}$; a material having a thermal conductivity≧200 $Wm^{-1}K^{-1}$; aluminum; an aluminum alloy; a magnesium alloy; a metal loaded plastics material; a carbon loaded plastics material; a thermally conducting ceramic material; and aluminum silicon carbide.

11. The device of claim 1, wherein the plurality of light emitting diodes are spaced around the opening with a separation such that a variation in intensity of light emitted by the device is less than about 25%.

12. The device of claim 11, wherein the light emitting diodes are separated with a spacing in a range to 1 to 5 mm.

13. The device of claim 11, wherein the light emitting diodes are grouped in arrays and the arrays of light emitting diodes are located around the at least one opening, and wherein the arrays of light emitting diodes are separated with a spacing in a range 1 to 5 mm.

14. The device of claim 1, and further comprising a lens arrangement overlying the light emitting diodes and configured to give a substantially uniform intensity emitted light.

15. The device of claim 1, and further comprising at least one phosphor material overlying the plurality of light emitting diodes, said phosphor material being operable to absorb at least a part of the light emitted by an associated light emitting diode and to re-emit light of a different wavelength.

16. The device of claim 1, and further comprising an electrical connector for connecting the device to a power source selected from the group consisting of: an Edison screw base; a bayonet connector base; a double contact bayonet connector base, a bipin base and a GU10 turn and lock connector base.

17. A light emitting diode lighting device comprising:

a thermally conducting body having at least one flue connecting an opening in the body with an outer surface of the body, wherein the thermally conducting body is symmetric with a central axis;

a plurality of light emitting diodes mounted in thermal communication with a face of the body and positioned around the at least one flue opening; and a plurality of heat radiating fins extending from an internal surface of the at least one flue to aid in dissipation of heat;

wherein the flue is configured such that in operation air moves through the at least one flue by thermal convection thereby to provide cooling of the body.

18. The device of claim 1, wherein the angle of inclination between the convection passage and the central axis of the thermally conducting body is selected to be about 0°, when the lighting device is operated in a vertical orientation; and about 90°, when the lighting device is operated in a horizontal orientation.

19. The device of claim 1, wherein at least one passage is configured to be in different groups, wherein each group has a different inclination angle.

20. The device of claim 19, wherein at least one passage is configured to be in two groups, wherein one group has an angle of inclination of about 10°, and another group has an angle of inclination of about 30°.

21. The device of claim 1, wherein the angle of inclination between the convection passage and the central axis of the thermally conducting body is selected from a range from about 0° to about 90°, wherein the selected angle of inclination corresponds to an operation orientation of the lighting device in order to optimize cooling of the body by allowing heated air to escape from the at least one cavity.

* * * * *